United States Patent [19]

Ferrara

[11] 3,967,413

[45] July 6, 1976

[54] VIBRATORY FINISHING SYSTEMS

[75] Inventor: Achille K. Ferrara, Addison, Ill.

[73] Assignee: Ultramatic Equipment Company, Addison, Ill.

[22] Filed: Nov. 15, 1974

[21] Appl. No.: 524,257

[52] U.S. Cl. ..... 51/163.1
[51] Int. Cl.[2] ..... B24B 31/06
[58] Field of Search ..... 51/7, 163

[56] References Cited

UNITED STATES PATENTS

| | | | |
|---|---|---|---|
| 3,157,004 | 11/1964 | Musschoot | 51/163 X |
| 3,464,163 | 9/1969 | Ferrara | 51/163 X |
| 3,541,738 | 11/1970 | Rampe | 51/163 |
| 3,793,780 | 2/1974 | Musschoot | 51/163 X |

FOREIGN PATENTS OR APPLICATIONS

| | | | |
|---|---|---|---|
| 236,830 | 3/1964 | Australia | 51/163 |

*Primary Examiner*—Harold D. Whitehead
*Attorney, Agent, or Firm*—Alter and Weiss

[57] ABSTRACT

A vibratory finishing system including a tub-like container mounted on resilient means. The top to bottom center line of the container is at an angle to the vertical. The top of the container slants downward from the rear to the front of the container. The interior of the container is substantially linear at the front thereof and arcuate at the rear thereof cooperating to amplify media and piecepart activity. The side walls flare outward to actuate transverse movement of the media and pieceparts. Tandem vibratory means are coupled at the rear of the container above the center line thereof. The plane of the tandem vibratory means can be varied from a position parallel to the top to bottom center line of the container to a position normal to the horizontal. The location of the tandem vibrators enables finishing heavy pieceparts without crushing the media and minimizing contact between the heavy pieceparts themselves and between the heavy pieceparts and the walls of the container.

12 Claims, 4 Drawing Figures

VIBRATORY FINISHING SYSTEMS

Figure 1:
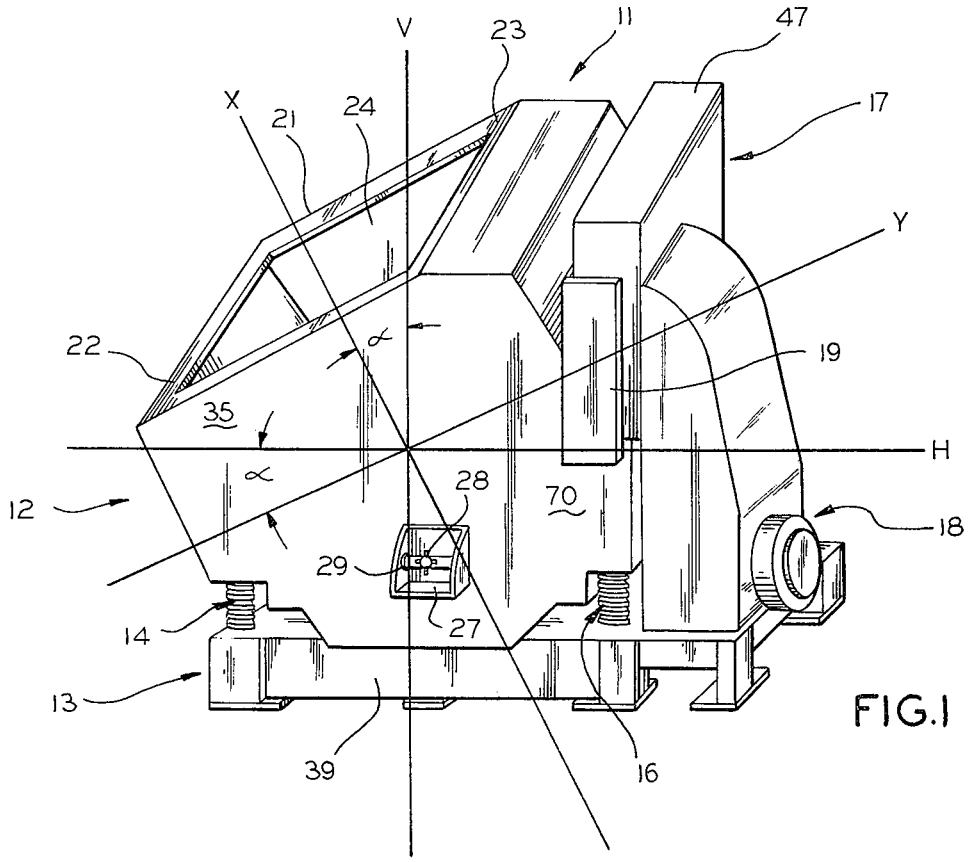

This invention relates to systems for finishing pieceparts; and more particularly, to vibratory systems for finishing large pieceparts.

It has been found that there are peculiar problems involved in deburring large and/or heavy pieceparts. When the pieceparts are heavy, then they are more apt to be damaged by striking other pieceparts and by striking the sides of the container. Further, regardless of the size of the pieceparts, a particular problem in manufacturing vibratory equipment for deburring pieceparts is to obtain the most active and efficient vibratory motion in the container for assuring the frictional contact between the finishing material used in the container and the pieceparts.

The resonant system in such vibratory finishing systems includes such things as the container, the resilient devices upon which the container is mounted, the mass of the container, the finishing media and the pieceparts within the container, the vibratory equipment for vibrating the container, and the method of mounting the vibratory equipment to the container, as well as the shape of the container. The shape of the container also must be predicated upon the efficacy of loading and unloading the container.

In the past, the finishing of heavy pieceparts in vibratory equipment has been totally unsatisfactory. The heavy pieceparts crush the media and tend to crash into each other and the walls of the container damaging both.

Yet another consideration in the manufacture and use of such vibratory systems is the capability of efficiently varying the size of the containers.

Accordingly, an object of the present invention is to provide new and unique vibratory systems for deburring and finishing pieceparts.

A related object of the present invention is to provide vibratory systems having containers with the top to bottom center line of the container being at an angle to the vertical.

Another object of the present invention is to provide vibratory systems capable of deburring heavy pieceparts without damaging the pieceparts through impact between the pieceparts and the walls of the container or the pieceparts themselves.

A related object of the invention is to provide vibratory systems wherein a plurality of tandem vibration actuators are used and the plane of the tandem vibration actuators is at an angle to the vertical.

Yet another related object of the invention is to provide vibratory systems wherein the plane of the tandem vibration actuators is normal to the horizontal.

Still another related object of the invention is to provide vibratory systems wherein the angular position of the plane of the tandem vibration actuators can be varied over a range extending from being parallel to the top to bottom center line of the container to being normal to the horizontal.

Another object of the present invention is to provide vibratory systems having containers internally shaped so that the rear and bottom of the containers are arcuate and the front of the containers are tangential to the arc.

Still another object of the present invention is to provide containers shaped to cause transverse or sidewise movement of the media and pieceparts in addition to front to back orbital counter-clockwise movement.

Yet another object of the present invention is to provide vibratory equipment wherein the top front of the container is lower than the top rear of the container.

A related object of the invention is to provide deburring and finishing equipment wherein tandem vibration actuators are attached to the containers above the horizontal center line of the containers.

Yet another object of the invention is to provide deburring and finishing equipment wherein tandem vibration inducing units are attached to the container so that the plane of the vibration actuators is not normal to the shortest line extending from the center of mass of the container to the plane of the tandem vibration actuators.

Yet another object of the invention is to provide deburring and finishing equipment having vibration actuators attached to the rear of the container with the container resting on front and back resilient means, there being a difference in resiliency between front and back to provide for a high degree of orbital activity in the container where needed to overcome gravitational forces.

In a preferred embodiment of the invention a tub-like container is resiliently mounted to a base. The top of the tub is at an angle to the horizontal, to facilitate the loading and unloading of the tub. The inside of the tub is arcuate at the rear and bottom thereof with the front side being tangential to the arc. The inner side walls of the container are flared so as to provide transverse movement of the pieceparts and media simultaneously with their orbital movememt. The center line of the tub-like container going from its top to its bottom is at an angle to the vertical. Similarly, the center line of the container going from its front to its back is at an angle to the horizontal. The springs between the base and the container are vertically mounted coil springs with approximately twice as many springs mounted at the back of the container as there are at the front.

A plurality of vibration actuators are preferrably tandemly mounted with the mounting plane of the actuators positionally adjustable from being vertical to being substantially normal to the top of the tub.

The complete system comprising the springs, the mass of the container, the deburring media with pieceparts and the vibration actuators resonates so as to provide optimum frictional engagement between the pieceparts and the media while minimizing the striking of the inner walls of the container by the pieceparts. The tub is fabricated in identical sections enabling variations in the dimensions of the tubs by increasing or decreasing the number of sections.

Figure 4:
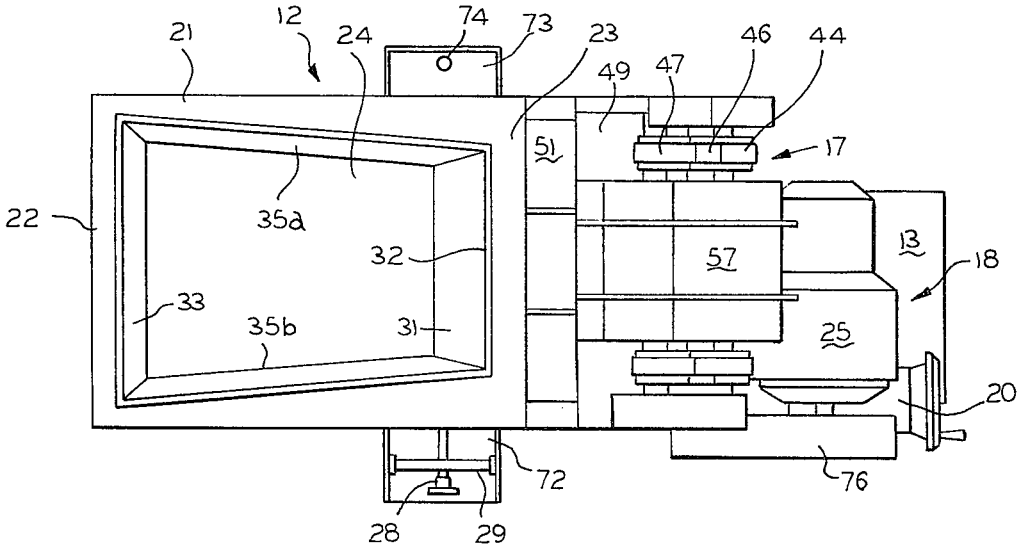
Figure 2:
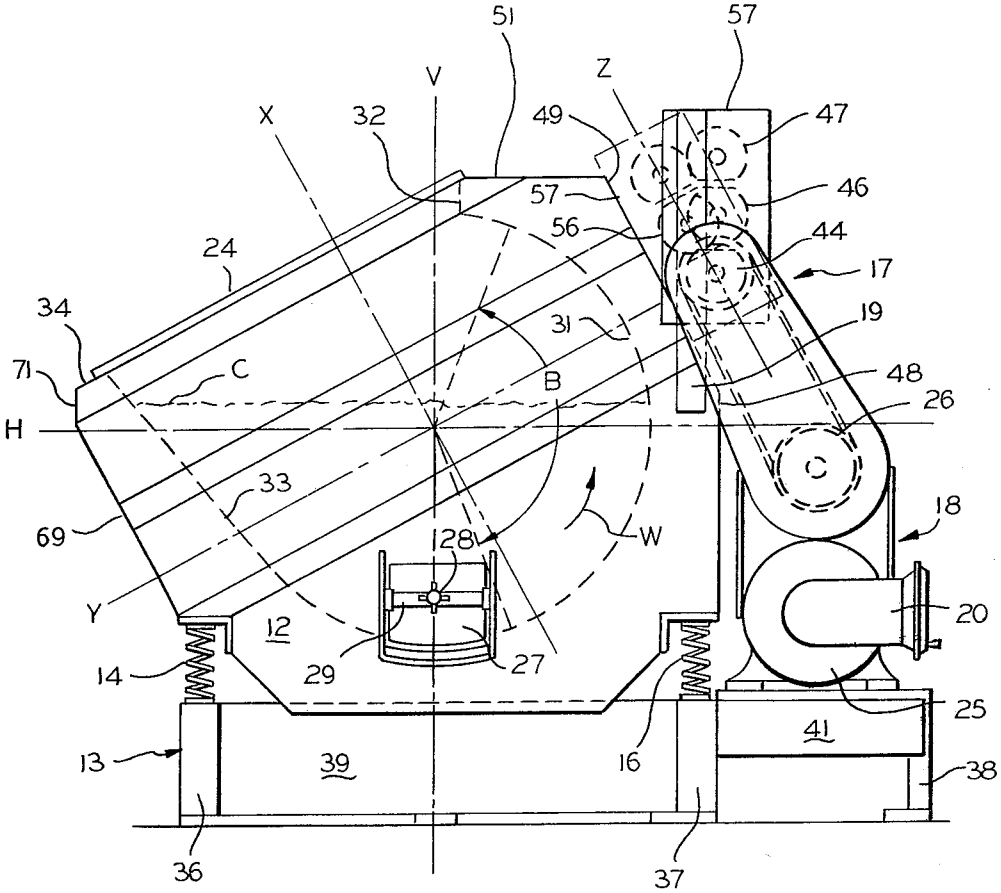
Figure 3:
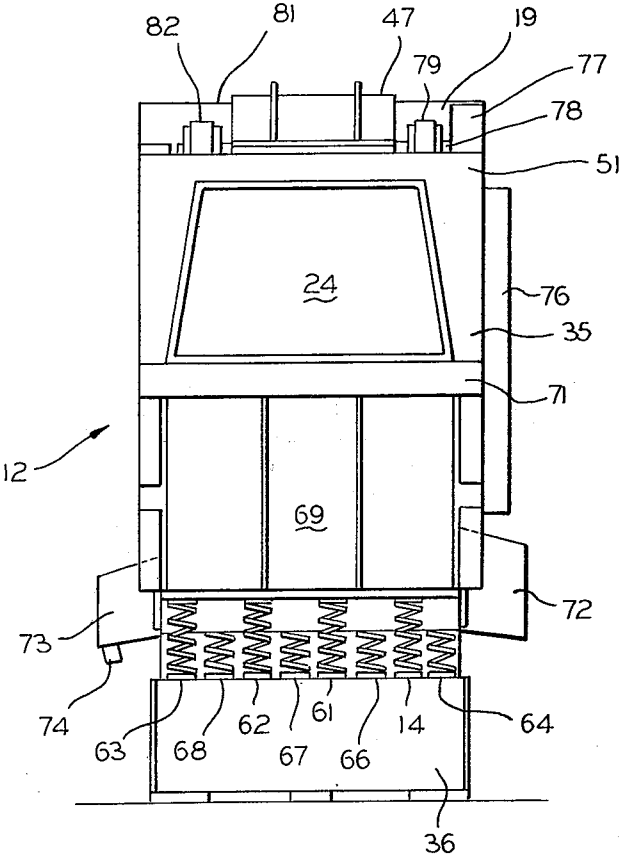

The above mentioned and other objects of the present invention as well as other features, together with the manner of obtaining them will become more apparent and the invention itself will be best understood by making reference to the following description of a preferred embodiment of the invention taken in conjunction with the accompanying drawings, in which:

FIG. 1. is a pictorial view of the vibratory finishing system;

FIG. 2. is a side view of the vibration finishing system shown in FIG. 1., showing the positional variations of the tandem actuators;

FIG. 3. is a front view of the vibratory finishing system, shown in FIG. 1.; and FIG. 4 is a partial plan view of the vibratory finishing system of FIG. 1.

In FIG. 1 the vibratory finishing system is shown generally as 11. It comprises a tub-like container 12 resiliently mounted to a base 13 through means, such as the vertical coil springs shown at the front and rear of the container as springs 14 and 16, respectively.

Means are provided for inducing vibration. More particularly, there are shown vibration actuator means 17 driven by motor 18. The vibration actuating means 17 are shown attached to a mounting plate 19 that is in turn attached above the center line of the container 12 at the rear wall thereof by welding or using other fastener means. The mounting plate 19 is shown as being vertical in FIG. 1. However, as shown in FIGS. 2 and 4, the deburring and finishing system operates with the vibration actuating means mounted either vertically or at an angle to the vertical. The angle is variable at least between the vertical and a line parallel to the top to bottom center line X of the container. The center line X makes an angle alpha with a vertical center line V. Similarly, the front to rear center line Y of the container 14 makes an angle alpha to a horizontal center line H. It has been found that mounting the vibration actuating means in tandem above the center line of the container and in a plane at an angle to the vertical agitates the media in a way that enables the system to finish heavy pieceparts. The agitator of the media precludes the crushing of the media by the pieceparts and minimizes the incidents of impact between the pieceparts themselves and the pieceparts and the walls of the container.

Means are provided to facilitate loading and unloading pieceparts. More particularly, the top of the container designated as 21 has its front 22 lower than its rear 23. This difference of level of the back and front side of the container makes the opening of the container 24 more accessible. The finishing media is unloaded through access door 27 held locked by means, such as locking handle 28, attached to locking bar 29.

Preferrably, the drive motor means 18 which is attached to the vibrator actuators through tansmission means, such as belt 26, includes an electric motor 25, a variable speed drive means, 20 capable of adjusting the speed of the belt from 1100 to 1800 RPM. The variation in speed controls the period of vibration.

In FIG. 2 there are shown means for precluding the pieceparts from contacting each other or the walls of the container. More particularly, the shape of the container in cooperation with the placement of the tandem actuators is designed to maximize the relative movement of the pieceparts and the media, while minimizing contact between the pieceparts and the walls of the container.

As shown in FIG. 2, the rear inner wall 31 of the container is arcuate. The rear wall's center point is shown as the intersection of the X and Y axes. The arcuate portion extends from the rear wall 32 of opening 24 around to the front wall 33 which is tangential to the arcuate portion 31. The front wall 33 extends upward until it intersects the horizontal flange section 34 that is peripheral to the front of opening 24.

The side walls, such as side wall 35, are planar vertical sections. The inner side walls 35*a*, 35*b* are shown flaring outwardly from rear to front and from bottom to top. The outward flares impart transverse motion to the media and pieceparts simultaneously with the regular orbital motion caused by the combination of vibrators and resilient members of the apparatus. The added transverse movement increases the interaction between the media and the pieceparts. While both back to front and bottom to top flaring is shown, the transverse motion is also caused by flaring in a single direction.

The base 13 comprises standards 36 at the front of the container, standards 37 at the rear of the container and standards 38 at the rear of the entire unit. Plate 39 is connected between standards 36 and 37. The standards 36 and 37 are preferably beams which are used for mounting the springs, such as springs 14 and 16, respectively. A beam 41 is connected between standards 37 and 38 which is used for mounting the motor means 18.

The vibration actuators 17 are shown in FIG. 2 as comprising three tandem vibrators 44, 46 and 47. Preferrably, the vibrators are of the eccentric weight variety, such as shown in may previously filed patent application Ser. No. 457,972, filed on Apr. 4, 1974. The three vibrators 44, 46 and 47, which run parallel to the transverse axis of the tub-like container and are mounted on axles, are eccentric weights. The axles are turned by the belt 26 coming from the motor arrangement 18.

The eccentric weight vibrators are mounted to the plate 19, that is coupled directly to the outside rear portion 48 of the container. The coupling between the plate 19 and the portion 48 of the container preferrably occurs above the horizontal center line H of the container.

In dotted line form an alternative embodiment is shown with the vibrators mounted directly to the section 49 of the rear outer wall of the container. Section 49 extends from horizontal section 51 at the top of the container, down to the vertical portion of the container 48. The section 49 is substantially parallel to the center line X of the container.

The vibrators are shown covered by a hood 57 in FIGS. 1, 3 and 4. The vibration set up by the vibrators causes counter-clockwise movement of the finishing media as indicated by arrow W in FIG. 2. The finishing media when actuated by the vibrators in resonance with the springs, move in a circular, spiral-like manner and rise above the normal unactuated level of the media at the rear of the container along with the pieceparts and move downward along a forward going arc to a level below the normal level of the finishing media at the front of the container. There the media and pieceparts are drawn down parallel to the inner periphery of the container and back to the starting point. The flared side walls impart the additional transverse motion that substantially adds to the interaction between the pieceparts and the media.

It is noted that by having twice as many springs 16 on the rear side as there are springs 14 on the front side, there is strong upward movement in section B, designated as 11 in FIG. 2, which causes the pieceparts to be actually forcefully pulled down into the finishing media on the front side much quicker than they are when there are the same number of springs at the front and the rear. Thus, normally with the same number of sorings, front and rear, the pieceparts upon being thrown up at the rear side fall along an arc onto the finishing media at the front side of the container where they often stall, so that many times pieceparts tend to crash into each other which is often damaging to either one of the pieceparts. However, with fewer springs 14 on the front side, this stalling is prevented and the collisions between the pieceparts and also with the walls of the container are minimized.

If has also been noted when the vibrators are attached to plate 19, rather than to section 49, there is more action in the area designated as B. This is the area wherein the media and pieceparts are working against gravity; and it is in this area that it is essential to get a lot of action to assure complete interaction of the media and pieceparts so as to accomplish the deburring and finishing in the most effective manner. In the other sections, that is as the pieceparts and the media come from the section B, gravity takes hold and aids in the movement of the media and the pieceparts.

In FIG. 3 the front view of the improved deburring and vibratory system, beam 36 is seen as supporting the springs 14, 61, 62 and 63. Beam 37 supports springs right behind those springs in addition to springs 64, 66, 67 and 68.

The container 12 is seen as having its opening 24 visible in the front view. The container comprises a series of sections such as modular sections 69 interconnected to similar modular sections at ribs, such as rib 70*a*, and to side walls, such as side wall 35. The top of the sections are covered by flange section 71 which runs around the entire periphery of opening 24. The modular sections are easily joined together to vary the size of the tub-like container.

At the rear of the front opening is the horizontal section 51 to which may be attached a hood for covering the vibrator. Also, extending upward and behind the container is the mounting plate 19 to which is attached the vibrator actuators covered by hood 57.

A material removal duct 72 is shown. This is associated with the door and locking mechanism 27 – 29. A fluid removal duct is shown at 73 having a drainage opening therein at 74.

A hood for covering the transmission belt 26 is shown at 76. The vibrating equipment is shown as having a driven wheel 77 connected to the belt 26 to drive a driven shaft 78. The driven shaft operates through a bearing block 79 to rotate the eccentric weights set in section 81. Another bearing block 82 equalizes the rotational forces on the eccentric weights and acts to anchor down the axle of use for rotating the eccentric weights. Each of the separate eccentric weighted vibrators is attached through a base, not shown, to the mounting plate 19 or the back of the container.

In operation, the container 12 is filled up to line C with the finishing media. The pieceparts are placed therein, and the vibrator is energized. Vibrations cause the finishing media and the pieceparts to rotate in a counter-clockwise manner so that they will start from the front side and rotate around through section B where they are then forced upward, along with the media on an arcuate path back into the mass of the media at the front of the container. The flared side walls impart a transverse motion to the media and pieceparts at the same time. This transverse motion adds to the activity of the contents of the container speeding the finishing action.

The apparatus and system shown herein causes an extreme agitation in section B. The inertia of that agitation assures that the pieceparts continue through the entire pathway through the media in a path of a fairly uniform velocity. Thus, the pieceparts are kept from striking one another and from striking the side walls of the container. The action of the finishing media deburrs and finishes the pieceparts, large as they are, in a minimum of time.

The period of vibration is adjustable by adjusting the speed of the motor, and the amplitude of vibration can be varied by varying the position of the plurality of tandem vibrators between having their axes aligned vertically or at an angle to the vertical. The variation in position varies the lever arm between the vibrator and center of gravity of the tub and contents. The mode of vibration can be further varied by varying the number of springs, such as the springs 14 and 16. The most efficient operation is when the resiliency, front to rear, is approximately two to one, and with the plane of the tandem vibrators attached to support plate 19 set vertically. With this arrangement a natural resonant point of the vibrating container and its contents is achieved that reduces the power requirements and the noise level of the equipment.

While the principles of the invention have been described above in connection with specific apparatus and applications, it is to be understood that this description is made only by way of example, and not as a limitation on the scope of the invention.

I claim:

1. A vibratory finishing system, said system including a tub-like container for receiving therein finishing media and pieceparts requiring finishing, base means, resilient means for mounting said tub-like container to said base, vibratory means mounted to said container to vibrate said container causing said media and pieceparts to move in a orbital counterclockwise direction rising in the back and falling in the front of said container, whereby said finishing media interacts with said pieceparts to debur and finish said pieceparts, said tub-like container having an opening normally slanting downwardly from back to front, and the inner left and right side walls of said container flaring outwardly for inducing a transverse motion to the media in addition to the orbital motion while said container is vibrating.

2. The improved vibration finishing system of claim 1 wherein the container is internally shaped so that the rear and bottom of the container are arcuate and the front of the container is tangential to the arc of the bottom of the container.

3. The improved vibratory finishing system of claim 1 wherein said vibratory means comprises tandem vibrators coupled to the container to vibrate solely above the center line and at the rear of said container, whereby the shape of said container and the position of the vibratory means acts to maximize media agitation and to simultaneously move the pieceparts at a uniform velocity to minimize contact between the pieceparts and the sides of the container and between the pieceparts themselves.

4. The improved vibratory finishing system of claim 3 wherein said tandem vibrators lie on a plane that is perpendicular to the horizontal plane.

5. The improved vibratory finishing sytem of claim 3 wherein said tandem vibrators lie on a plane that is substantially perpendicular to the slanted opening of the container.

6. The improved vibratory finishing system of claim 5 wherein said tandem vibrators are on a plane that can be varied between being perpendicular to the horizontal plane to being perpendicular to the slanted opening of said container.

7. The improved vibratory finishing system of claim 6 wherein said resilient means between the container and the base comprise separate coil springs along the front and along the rear of the container, and where there are more coil springs at the rear of the container than there are at the front of the container.

8. The improved vibratory finishing system of claim 7 wherein means are provided for varying the size of the container, said means comprise standard sections used in fabricating the container, adapted for the expedient addition or removal of such sections, and wherein said tandem vibrator means also comprise separate sections for easy addition or removal of the sections to vary the size of the vibrators to conform to the size of the container.

9. A vibratory finishing system including a tub-like container for receiving finishing media and pieceparts requiring finishing therein, base means, resilient means mounted at the front and rear of said container with more resilient means located at the rear of said container than at the front of said container, whereby the rear of the container has relatively greater resiliency than the front of the container, vibratory means mounted to said container to vibrate said container and cause the contents thereof to rotate in a counter-clockwise direction from the front to the rear of the container rising at the rear and falling at the front, said container having a slanted opening at the top thereof, the front inner wall of said container being planar, set an an angle to the vertical, and extending from the front of said slanted opening, the rear and bottom inner walls of the container being globular, said rear inner wall extending to the rear of said slanted opening, whereby the inner shape of the container is volute-like, the cross sectional area of the container being greater at the front section of the container where the contents are falling than at the rear of the container where the contents are rising, whereby the additional resiliency and cross sectional area differentials tend to overcome the gravitational pull on those contents at the rear and the front of the container, to cause the velocity of the contents throughout the entire counter-clockwise movement to be uniform.

10. The vibratory finishing system of claim 9 wherein the side walls are flared to impart a transverse motion to the contents of the container during the said counter-clockwise movement.

11. The vibratory finishing system of claim 10 wherein the side walls are flared outwardly from bottom to top and front front to rear, whereby the uniformity of the velocity is maintained.

12. The vibratory finishing system of claim 11 wherein said vibratory means is mounted solely above the center of gravity of said container.

* * * * *